United States Patent [19]

Peltier

[11] 4,145,829

[45] Mar. 27, 1979

[54] PROTECTIVE STAMP MOUNT

[76] Inventor: Gene J. Peltier, 1314 Grand Ave., Wausau, Wis. 54401

[21] Appl. No.: 833,129

[22] Filed: Sep. 14, 1977

[51] Int. Cl.[2] ..... G09F 1/10

[52] U.S. Cl. ..... 40/158 R

[58] Field of Search ..... 40/158 B, 158 R, 159, 40/152, 158; 16/DIG. 13

[56] References Cited

U.S. PATENT DOCUMENTS

| | | | |
|---|---|---|---|
| 764,273 | 7/1904 | Denton | 40/159 |
| 2,179,884 | 11/1939 | Falkoff | 40/159 |
| 2,268,529 | 12/1941 | Stiles | 40/159 |
| 4,044,483 | 8/1977 | Williams | 40/152 |

*Primary Examiner*—Russell R. Kinsey
*Assistant Examiner*—Wenceslao J. Contreras
*Attorney, Agent, or Firm*—Henry C. Fuller

[57] ABSTRACT

A protective stamp mount has a pair of opposed transparent glass plates which are hinged together by a silicone cement which is received in a recess formed by beveled adjacent edges of the plates. The other three edges of the plates can also be beveled to provide a recess for permanently sealing the stamp between the plates. A spacer and border provides clearance between the plates. In a modified embodiment, a continuous rectangular metal band is sized to receive the plates and provide a metallic periphery for the plates to protect the edges thereof.

5 Claims, 4 Drawing Figures

PROTECTIVE STAMP MOUNT

BACKGROUND OF INVENTION

Prior art patents such as U.S. Pat. No. 764,273 and U.S. Pat. No. 2,179,884 disclose mounts intended for use with stamps to provide protection therefore. The U.S. Pat. No. 764,273 does not disclose a hinge connection between the plates but discloses fastening of the plates by strips between the plates with the use of an adhesive. U.S. Pat. No. 2,179,884 discloses a cellophane or celluloid-type enclosure in the form of a flexible envelope sealed between the adjacent edges. Neither of these patents provide for easy retrieval of the stamp and appear to afford adequate protection for the stamp.

SUMMARY OF INVENTION

The invention provides a stamp mount assembly which is attractive and neat in appearance and which employs opposed glass plates with beveled edges which form a recess for a silicone cement. With the adhesive fastened along only one adjacent edge of the plates, the silicone cement functions as a hinge which affords repeated opening and closing of the plates for removal and insertion of stamps. Expensive stamps can be completely sealed by application of silicone cement in recesses surrounding all four edges of the glass plates. The positioning of the cement in the recesses and the translucent or transparent character of the cement provides a smooth uniform edge for the mount which is neat in appearance and almost imperceptible. To permanently mount stamps, a rectangular metal band is provided which is complementary in shape to the plates and is sized to receive the plates. The band is spaced slightly from the edges thereof to enable expansion of the plates due to temperature variations. The metal band further protects the mount, and particularly the edges of the plates in the event the assembly is dropped.

Further objects and advantages and features of the invention will become apparent from the disclosure hereof.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 2:
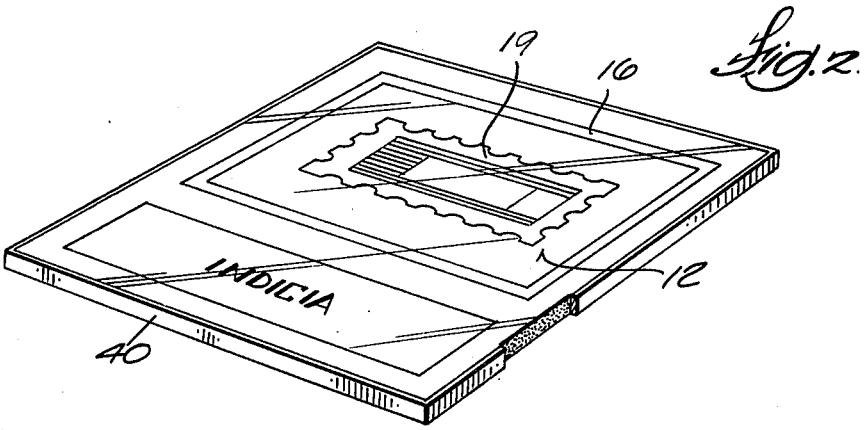
FIG. 2 is a perspective view of a modified embodiment.
Figure 1:
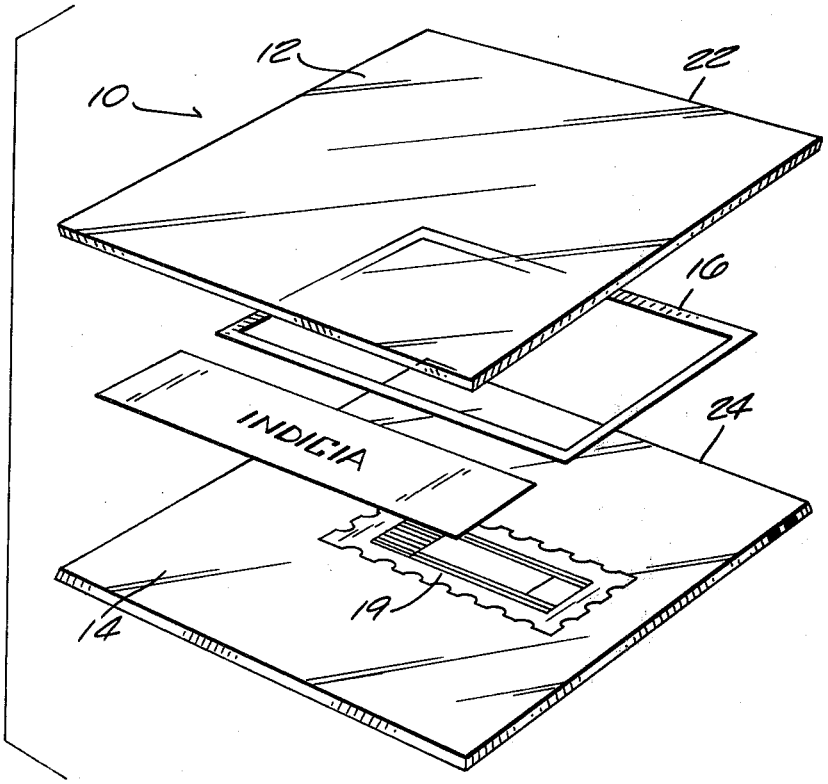
FIG. 1 is an exploded perspective view of the stamp mount of the invention.

As illustrated in FIG. 1, the protective stamp mount 10 includes an upper transparent plate 12 and a lower plate 14. The glass plates are desirably constructed with a non-glare glass, which is also preferably coated to prevent ultraviolet deterioration of the dyes in the stamps. Plates which are square or rectangular in shape having dimensions of 3 inches by 3 inches are adequate for most stamps. However, larger glass plates 12, 14 can be employed for blocks of four stamps and souvenir sheets, and also for first day covers.

A spacer and border 16 is provided to slightly space the plates 12 and 14 when assembled so that the stamp 18 is loose within the plates and not firmly pressed. A label 18 is also provided which is desirably the same thickness as the border and spacer 16. The thickness of the spacer 16 and the label 18 is suitably increased to provide sufficient spacing for first day covers.

Figure 3:
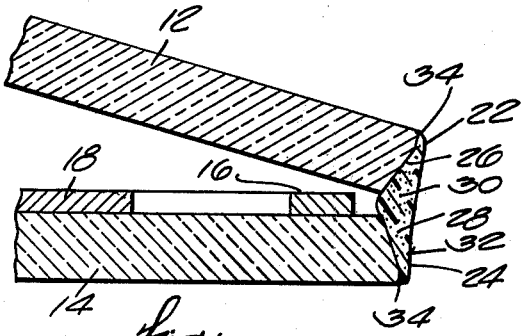
FIG. 3 is an enlarged sectional view of the assembly shown in FIG. 1.

In accordance with the invention, as best shown in FIG. 3, at least the rear edges 22 and 24 of plates 12 and 14 are beveled inwardly at 26 and 28 to provide a recess 30. The recess 30 provides a space for a silicone cement or other comparable elastomeric adhesive 32 which connects the plates 12 and 14 and affords hinged opening and closing movement of the plates for insertion and removal of stamps. The beveled edges 26, 28 are also desirably provided with a chamfer 34 to eliminate sharp edges.

Figure 4:
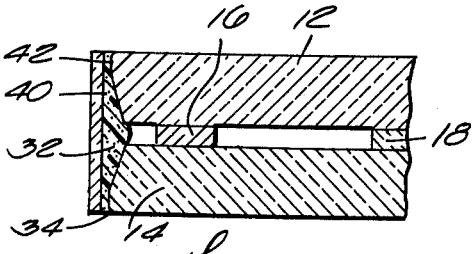
FIG. 4 is an enlarged fragmentary sectional view of FIG. 2.

In a modified embodiment of the invention, as illustrated in FIG. 4, a rectangular metal band 40, which is complementary in shape to the plates 12 and 14 and slightly oversized to provide clearance between the plates 12 and 14, is employed to provide a permanent seal around the periphery of the plates 12 and 14. A slight clearance at 42 between the chamfered edges 34 and the band 40 will accommodate expansion and contraction of the glass plates. The band 40 provides a neat, uniform periphery for the mount and confines the silicone cement 32 in the recesses 30. The bands 40 can be installed in a vacuum or gas chamber to hermetically seal stamps within the plates 12, 14.

What is claimed is:

1. A protective stamp mount comprising a pair of opposed transparent glass plates, said plates having adjacent beveled edges to provide a recess, border and spacer means between said plates for spacing said plates to provide clearance for a stamp contained between said plates, and elastomeric sealing means along said adjacent beveled edges of said plates in said recess for hingedly connecting said plates together.

2. A protective stamp mount in accordance with claim 1 wherein said beveled edges are chamfered to eliminate sharp outer edges.

3. A protective stamp mount in accordance with claim 1 wherein all adjacent edges of said plates are beveled inwardly to provide a continuous recess, and elastomeric sealing means to seal all adjacent edges of the plates together.

4. A protective stamp mount in accordance with claim 3 wherein said plates are rectangular and including a metal band complementary in shape to said plates and sized to receive the plates within said band, and elastomeric sealing means located between said band and the edges of said plates.

5. A stamp mount in accordance with claim 4 wherein said band is sized to receive said plates and provide slight clearance between the band and the plates to enable temperature expansion of said plates.

* * * * *